United States Patent [19]

Thopsey et al.

[11] 4,318,507

[45] Mar. 9, 1982

[54] MAIL ARRIVAL FLAG SYSTEM

[76] Inventors: Floyd Thopsey, 214 E. Rocks Rd., Norwalk, Conn. 06851; Anthony J. De Panfilis, 96 Silvermine Ave., Norwalk, Conn. 06850

[21] Appl. No.: 147,957

[22] Filed: May 8, 1980

[51] Int. Cl.[3] ..... B65D 91/00

[52] U.S. Cl. ..... 232/35

[58] Field of Search ..... 232/35, 34, 45

[56] References Cited

U.S. PATENT DOCUMENTS

| | | | |
|---|---|---|---|
| 3,026,025 | 3/1962 | Hanson | 232/35 |
| 3,034,706 | 5/1962 | Wing | 232/35 |
| 3,318,516 | 5/1967 | Scheerer | 232/36 X |
| 3,606,141 | 9/1971 | Taylor | 232/35 |
| 3,675,845 | 7/1972 | Scheerer | 232/35 |
| 3,722,460 | 3/1973 | James, Sr. | 232/35 X |
| 3,958,752 | 5/1976 | Pieszchala | 232/35 |
| 4,073,430 | 2/1978 | Joris | 232/35 |
| 4,154,392 | 5/1979 | Galstad | 232/35 |

*Primary Examiner*—Roy D. Frazier
*Assistant Examiner*—Peter A. Aschenbrenner
*Attorney, Agent, or Firm*—Charles E. Temko

[57] ABSTRACT

A pivotally mounted flag assembly for use with rural type mail boxes to automatically indicate that a pivotally mounted door of the box has been opened. The door pivotally mounts one end of a relatively stiff wire, the opposite end of which penetrates an oppositely disposed vertical wall of the box to engage a weighted semaphore type signal, the release of which causes the signal to rotate under the force of gravity to expose a free end thereof above the mail box where it may be viewed from a distance.

1 Claim, 3 Drawing Figures

MAIL ARRIVAL FLAG SYSTEM

BACKGROUND OF THE INVENTION

This invention relates generally to the field of mail box signals of the type disclosed, for example, in U.S. Pat. No. 2,480,469, granted Aug. 30, 1949 to C. P. Horn, and more particularly to an improved form thereof in which prior art disadvantages have been substantially eliminated.

The current state of the art has reached a currently high degree of development, consistent with changes in delivery by post office personnel. The traditional rural mail box includes a side mounted signal flag which can be raised to erected condition by the postman to indicate delivery. However, delivery at the present time is usually made without alighting from a vehicle, and the flag, being mounted along a side wall, is not always available to the postman, as is the end mounted door of the box.

The problem has been a long standing one. The Morrow U.S. Pat. No. 812,514 of Feb. 13, 1906 discloses an early attempt to resolve this difficulty. Unfortunately, the signal erection means requires the cutting of the side wall of the mail box to expose delivered mail to the elements.

The Smith U.S. Pat. No. 1,973,020, of Sept. 11, 1934 pivotally mounts a small flag to the rear side wall of the box, operated by an elongated wire linkage. With continued exposure to the elements, the linkage rusts to the point where it is no longer serviceable.

The above mentioned Horn patent substitutes an equally rustable coil spring for the linkage of Smith, with the same accompanying disadvantage.

The McMinn U.S. Pat. No. 2,849,176 of Aug. 25, 1958 employs a pair of elongated coil springs which control the opening and closing of the door of the mail box past a center point, the door including a flag which is raised period. Unfortunately, the position of the flag is not readily visible from all sides.

The Harger U.S. Pat. No. 2,954,920 of Oct. 4, 1960 includes a gravity mounted flag which disappears with the opening of the mail box so that the resetting of the same is sometimes forgotten by the user.

The Wing U.S. Pat. No. 3,034,706 of May 15, 1962 employs a pivotally mounted flag actuated by a coil spring disposed in the interior of the mail box.

The Joris U.S. Pat. No. 4,073,430 of Feb. 4, 1978 employs a disconnectible wire attached to a bracket on the inner surface of the door of the mail box. The wire must be manually reengaged with each cycle of operation, difficult in cold weather.

The Mapes U.S. Pat. No. 4,150,780 of Apr. 24, 1979 employs a side mounted signal operated by a stiff wire extending across the front of the mail box door.

All of the above constructions include parts which are subject to deterioration with continued exposure to the elements, and many are so flimsy as to preclude extensive use.

SUMMARY OF THE INVENTION

Briefly stated, the invention lies in the provision of an improved mail box signaling construction in which the disadvantages of the prior art constructions described hereinabove have been substantially eliminated. As in some of the prior art constructions, the operating means is disposed within the box so as to be shielded from the elements, and adjacent the line of joinder between the mail box floor and a side wall, so as not to interfere with the removal of the contents of the box. This means comprises a single length of relatively stiff wire, one end of which is permanently pivotally attached to the inner surface of the door, and the other end of which is supported by a short sleeve penetrating the rear wall to selectively project outwardly therethrough to latch a pivotally mounted signal on the outer surface of the rear wall. The signal is weighted, and is latched weighted end upward, so that when released, the weighted end swings downwardly to elevate the oppositely disposed end which comes to rest in position to be conveniently viewed. The signal is reset after closing the mail box door by manually returning the signal to its original position, the rear end of the wire engaging an open-ended slot in the signal. Thus, no springs or other resilient members are required.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
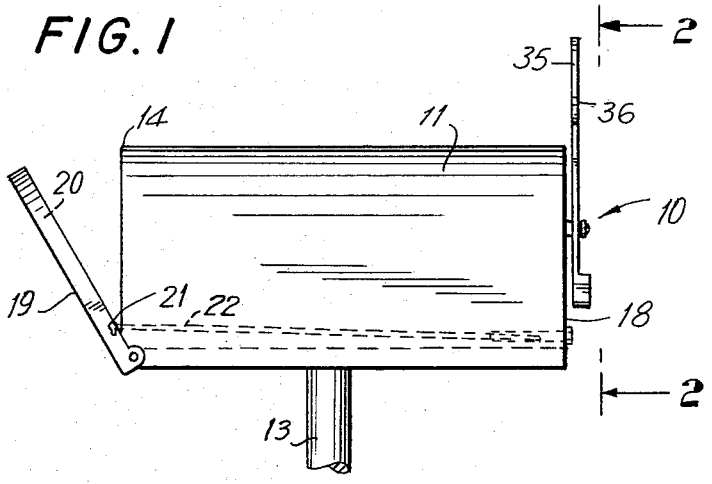
FIG. 1 is a side elevational view of an embodiment of the invention, partly broken away to show detail.
Figure 2:
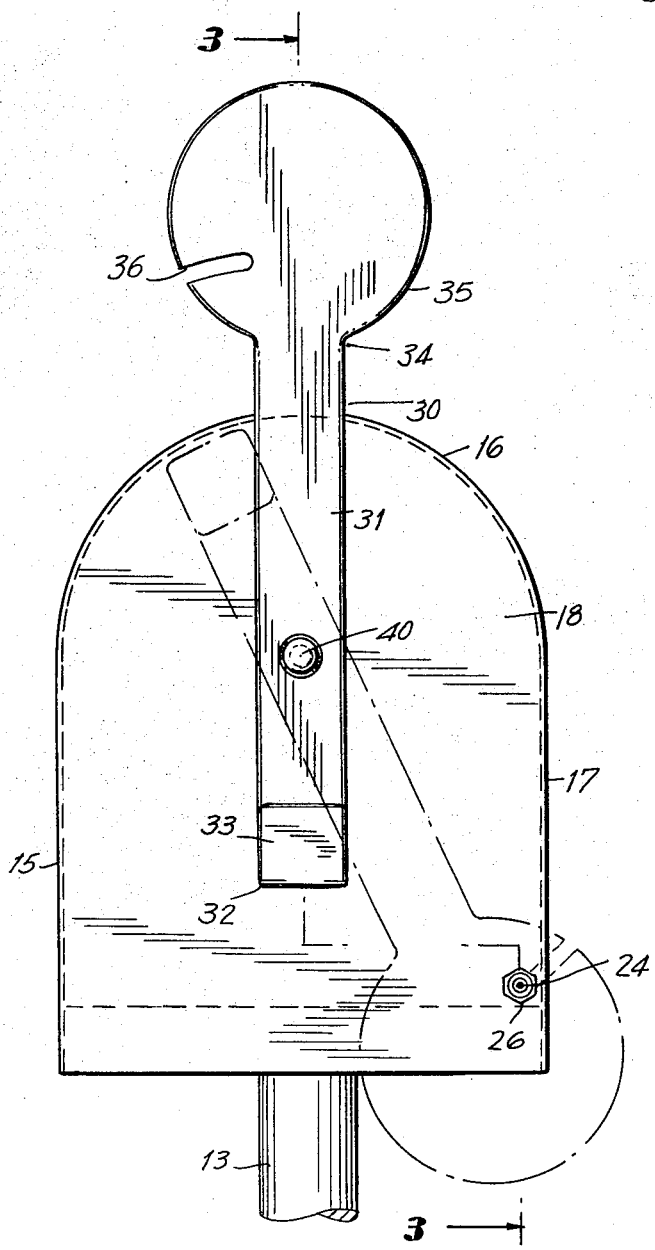
FIG. 2 is an enlarged vertical sectional view corresponding to the right hand portion of FIG. 1.
Figure 3:
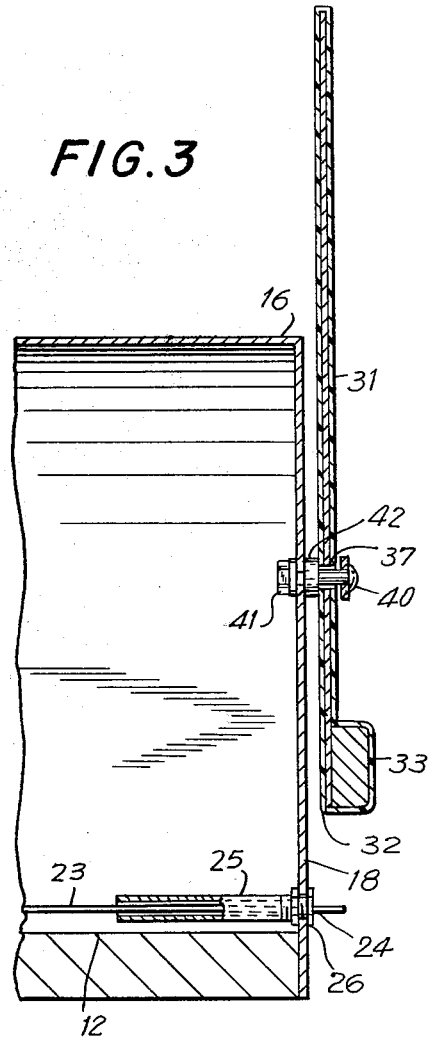
FIG. 3 is a rear elevational view thereof showing an alternate position of the signal.

In accordance with the invention, the device, generally indicated by reference character 10 includes a mail box element 11 having a lower wall 12 supported upon a vertical member 13 in a manner well known in the art. A sheet metal body 14 forms a first side wall 15, an upper wall 16, and a second side wall 17. A fixed end wall 18 is disposed opposite a pivotally mounted door 19.

The inner surface 20 of the door 19 is provided with a small loop 21 which engages one end 22 of an elongated wire 23. A second end 24 of the wire passes through a hollow sleeve 25 mounted in an opening 26 in the end wall 18, so as to project outwardly thereof when the door 19 is in closed condition.

A signal element 30 is most conveniently formed as a metallic stamping from aluminum, or other relatively rust resistant material. It includes an elongated body 31, a first end 32 of which is provided with a six to eight ounce weight 33, while a second end 34 includes an enlargement 35, preferably painted with a bright color. The enlargement 35 is provided with an open-ended slot 36 of arcuate shape. A medially disposed opening 37 permits the signal element 30 to be mounted for rotation by engaging bolt and nut means 40-41 between suitable washers 42.

Operation of the signal element 30 will be apparent from a consideration of the drawing. When the door is in closed position, and the signal element lowered, the second end 34 of the wire 23 engages the slot 36. As soon as the door has been opened, the slot 36 is released, thereby allowing the weight 33 to rotate the signal element 30 to a position where the enlargement 35 projects above the mail box to be readily visible from a distance. When the delivered mail has been removed from the box, and the door closed, the user merely rotates the signal element 30 in the same direction used to raise the enlargement 35, whereby the slot 36 reengages the second end of the wire, thus readying the signal element for another cycle of operation. It will be apparent that no resilient elements whatsoever are required for latching purposes, and substantially all of the latching means is positioned within the mail box, thus providing maximum shielding thereto from the elements.

We wish it to be understood that we do not consider the invention limited to the precise details of structure shown and set forth in this specification, for obvious modifications will occur to those skilled in the art to which the invention pertains.

We claim:

1. In an automatic signalling flag device for rural type mailboxes, said box having a hinged door at one end thereof, and a fixed vertical wall at an opposite end thereof, the improvement comprising: a relatively stiff wire slidably positioned within said box, said wire having a first end pivotally secured to an inner surface of said door, and a second end selectively projectable outwardly through an opening in said rear wall when said door is in closed condition; a signal element of generally elongated configuration having first and second ends, said first end having a weight thereon, said second end having a selectively displayed signal area thereon; pivot means penetrating said rear wall, and forming a pivot axis disposed above the point of projection of said wire through said rear wall, said signal element having a medially disposed opening penetrated by said pivot means, said second end having an open-ended slot selectively engageable with said second end of said wire which permits the end of the wire to engage the signal member at a point medially disposed with respect to its extremities; whereby upon the opening of said door, said signal element is released to cause said weight to rotate in a given direction to raise said signal area above said mail box, and after closing said door, said signal element might be manually rotated in the same direction to reengage said second end of said wire within said open-ended slot to position said signal area below said pivot means.

* * * * *